US008480951B2

(12) United States Patent
Matsumura et al.

(10) Patent No.: US 8,480,951 B2
(45) Date of Patent: Jul. 9, 2013

(54) TUYERE STRUCTURE OF MELTING FURNACE

(75) Inventors: Yasunari Matsumura, Tokyo (JP); Kohji Taoka, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 12/733,516

(22) PCT Filed: Aug. 27, 2008

(86) PCT No.: PCT/JP2008/065275

§ 371 (c)(1), (2), (4) Date: Mar. 5, 2010

(87) PCT Pub. No.: WO2009/034837

PCT Pub. Date: Mar. 19, 2009

(65) Prior Publication Data

US 2010/0320653 A1 Dec. 23, 2010

(30) Foreign Application Priority Data

Sep. 10, 2007 (JP) ..... 2007-233630

(51) Int. Cl.
*C21B 7/16* (2006.01)

(52) U.S. Cl.
USPC ..... 266/270; 266/47

(58) Field of Classification Search
USPC ..... 266/47
See application file for complete search history.

(56) References Cited

U.S. PATENT DOCUMENTS

| | | | | |
|---|---|---|---|---|
| 3,945,820 | A | 3/1976 | Brotzmann et al. | |
| 3,971,548 | A * | 7/1976 | Folgero et al. | 266/218 |
| 4,023,781 | A * | 5/1977 | Fritz et al. | 264/30 |
| 4,387,173 | A * | 6/1983 | Henry et al. | 524/63 |
| 4,709,905 | A * | 12/1987 | Winkelmann et al. | 266/270 |
| 4,749,408 | A * | 6/1988 | Tate et al. | 75/10.41 |
| 4,843,044 | A * | 6/1989 | Neville et al. | 501/111 |
| 5,863,490 | A * | 1/1999 | Yamada | 266/47 |

FOREIGN PATENT DOCUMENTS

| | | |
|---|---|---|
| JP | 1-316411 | 12/1989 |
| JP | 8-1310 | 1/1996 |
| JP | 9-41024 | 2/1997 |
| JP | 9-176720 | 7/1997 |
| JP | 2002-115011 | 4/2002 |
| JP | 2003-171706 | 6/2003 |
| KR | 10-0349870 | 1/2003 |
| RU | 2 244 019 | 1/2005 |
| RU | 2 254 379 | 6/2005 |
| SU | 605549 | 4/1978 |

OTHER PUBLICATIONS

International Search Report dated Dec. 2, 2008 issued in corresponding PCT Application No. PCT/JP2008/065275.

(Continued)

*Primary Examiner* — Scott Kastler
(74) *Attorney, Agent, or Firm* — Kenyon & Kenyon LLP

(57) ABSTRACT

A tuyere structure of a melting furnace includes: a tuyere main body which is covered on an outer periphery thereof with a ring member baked in advance, and is disposed in a hole portion provided in a tuyere brick; and a ramming material which fills a periphery of the ring member so as to fix the ring member.

5 Claims, 4 Drawing Sheets

OTHER PUBLICATIONS

Korean Office Action, dated Jan. 19, 2012, issued in corresponding Korean Application No. 10-2010-7004928, and an English translation thereof.

Russian Notice of Allowance dated Aug. 19, 2011 issued in corresponding Russian Application No. 2010109065 [with English Translation].

* cited by examiner

TUYERE STRUCTURE OF MELTING FURNACE

This application is a national stage application of International Application No. PCT/JP2008/065275, filed 27 Aug. 2008, which claims priority to Japanese Application No. 2007-233630, filed 10 Sep. 2007, which is incorporated by reference in its entirety.

TECHNICAL FIELD

The present invention relates to a tuyere structure of a melting furnace which does not cause damage in the vicinity of a tuyere and has sufficient strength, thereby extending the life of the tuyere.

BACKGROUND ART

From the past, as a tuyere of a melting furnace used for melting ores or the like or a melting furnace such as a cupola, there is a structure in which a tuyere main body is set in a hole portion provided in a tuyere brick. The gap in the hole portion between the periphery of the tuyere main body and the brick wall is filled with a fire-resistant ramming material, so as to fix the tuyere main body as disclosed in Japanese Unexamined Patent Application, First Publication No. 2003-171706. The tuyere is used so that the blast of high-temperature gas is forced through the tuyere into a furnace, and the tuyere main body has a cylindrical or conic shape made of copper or a copper alloy.

Since the tuyere is exposed to an environment in which high-temperature molten metal or slag is dropped and a flame temperature in front of the tuyere is equal to or higher than 2000° C., wear and melting loss occurs, and this causes a significant reduction in the life of the tuyere. Accordingly, in order to extend the life of the tuyere, various measures for lengthening the life of the tuyere, including a tuyere structure in which the cooling chamber of the tuyere is separated, a tuyere structure in which an internal cooling water passage is formed into a spiral shape, a tuyere structure in which wear-resistant metal is implanted, a tuyere structure in which the front end portion thereof is subjected to hardfacing or the surface thereof is coated with a fire-resistant material, a tuyere structure coated with heat-resistant and wear-resistant fabric, and the like, have been proposed and employed, In addition, the tuyere of a blast furnace adopts the structure in which the tuyere main body is disposed in the hole portion provided in the tuyere brick and the periphery (about 90 mm) of the tuyere main body is filled with a ramming material so as to be fixed. However, in case of the blast furnace, since the temperature in front of the tuyere is about 1100° C. and thus is low, melting loss of the ramming material is not observed, and it is sufficient that repair, replacement, and the like are needed only during regular furnace renovations of 10 to 20 years.

In addition, a melting furnace adopts a structure of lining fire-resistant material over an iron shell from a tuyere. However, there is a disadvantage in that when the applied fire-resistant material is damaged, the iron shell is exposed, and thermal insulation is deteriorated, resulting in an increase in heat loss.

On the other hand, with regard to the tuyere of the melting furnace, the flame temperature in front of the tuyere is equal to or higher than 2000° C. In the case where the ramming material is filled so as to be fixed like the cupola, wear and melting loss in the vicinity of the tuyere cannot be avoided, and frequent replacement and repair is needed for the tuyere and the vicinity thereof once in about 30 days. Moreover, when local melting loss occurs in the vicinity of the tuyere, the iron shell is exposed, and the thermal insulation is deteriorated, which causes a problem with an increase in operational load due to heat loss.

Under the circumstances, the development of a new tuyere structure capable of increasing the life of a tuyere is strongly required.

DISCLOSURE OF THE INVENTION

Problem that the Invention is to Solve

Therefore, the present inventors have researched into the causes of local melting loss in the vicinity of the tuyere. As a result, it was found that in a region of about 100 mm in the periphery of the tuyere, there are points where the ramming material is unoxidized and undiscolored after drying, melting loss does not occur in other parts where the ramming material is oxidized and discolored, and local melting loss occurs in the undiscolored points. In addition, the reason is explained that the undiscolored points come in direct contact with the tuyere main body which is cooled to be protected, the ramming material is not sufficiently dried, and the strength thereof cannot be sufficiently exhibited, so that the points are locally melted.

FIG. 3 is cross-sectional view of a tuyere structure of an existing example.

In FIG. 3, reference numeral 11 denotes a tuyere main body, reference numeral 13 denotes a ramming material, and reference numeral 14 denotes an iron shell. It can be seen that in a region (a peripheral region of about 100 mm) of the ramming material 13 in the vicinity of the tuyere main body 11, local melting loss portions 12*a* and strength-deficient portions 12*b* after drying exist.

In addition, a relationship between the baking temperature and the strength of the ramming material was examined. As a result, as shown in FIG. 4, it was found that in a case where baking was performed at a temperature of less than 120° C., the strength decreased to less than 18 MPa, a desired strength cannot be obtained. Therefore, it was determined that the strength of the ramming material needs to be more properly exhibited. In addition, it could be predicted that sufficient strength of the ramming material is related to the prevention of local melting loss in the vicinity of the tuyere.

The present invention has an object of providing a tuyere structure of a melting furnace which does not cause damage such as local melting loss in the vicinity of the tuyere and has sufficient strength, thereby significantly extending the life of the tuyere, and, which can eliminate a degradation of insulation effect due to exposure of the iron shell caused by the local melting loss and an increase in operational load due to heat loss.

Means for Solving the Problem

The present invention adopts the followings in order to solve the problem.

(1) A tuyere structure of a melting furnace according to the present invention includes: a tuyere main body which is covered on an outer periphery thereof with a ring member baked in advance, and is disposed in a hole portion provided in a tuyere brick; and a ramming material which fills a periphery of the ring member so as to fix the ring member.

(2) The ring member may be baked in advance at a temperature of equal to or higher than 120° C. so that the strength thereof becomes 18 MPa or higher.

(3) The ring member may be divided in a circumferential direction.

(4) The ring member made of the same material as that of the ramming material may be employed.

Advantage of the Invention

With the tuyere structure of the melting furnace according to (1) above, the structure is employed in which the tuyere main body, which is covered on the outer periphery thereof with the ring member baked in advance, is disposed in the hole portion provided in the tuyere brick, and the periphery of the ring member is filled with the ramming material so as to be fixed. Therefore, the ring member, which has sufficient wear resistance and strength since it is baked in advance, comes in direct contact with the tuyere main body which is cooled to be protected, so that there is no situation in which local melting loss portions of the ramming material or strength-deficient portions after drying occur unlike the existing structure. As a result, it is possible to exhibit sufficient strength and excellent durability.

With the tuyere structure of the melting furnace according to (2) above, since the ring member is baked in advance at a temperature of equal to or higher than 120° C. so that a strength thereof becomes 18 MPa or higher, the strength of the ring member is increased, and the ring member can properly support the tuyere main body.

With the tuyere structure of the melting furnace according to (3) above, since the ring member is divided in the circumferential direction, it can be easily mounted to the tuyere main body.

With the tuyere structure of the melting furnace according to (4) above, since the ring member is made of the same material as the ramming material, expansion coefficients of the two become the same, and a gap between the two does not occur with a temperature increase.

DESCRIPTION OF REFERENCE NUMERALS AND SIGNS

1 TUYERE MAIN BODY
2 RING MEMBER
3 RAMMING MATERIAL
4 IRON SHELL

BEST MODE FOR CARRYING OUT THE INVENTION

An embodiment of a tuyere structure of a melting furnace according to the present invention will be described with reference to the accompanying drawings.

Figure 1:
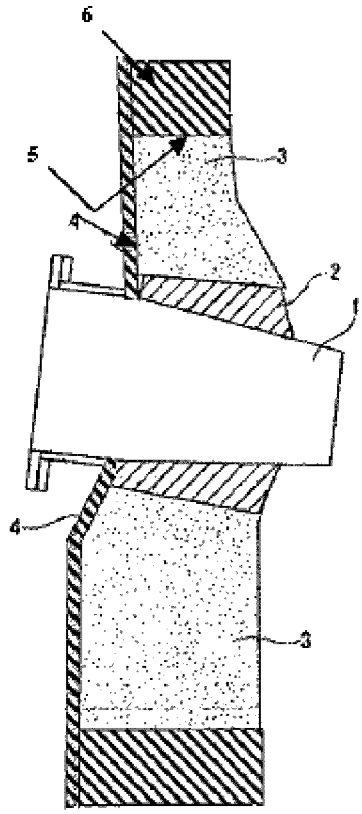
FIG. 1 is a cross-sectional view showing an embodiment of a tuyere structure of a melting furnace of the present invention.

FIG. 1 is a cross-sectional view showing a tuyere structure of this embodiment. Reference numeral 1 denotes a cylindrical tuyere main body made of copper or a copper alloy, reference numeral 3 denotes a ramming material made of ceramic mainly containing alumina as the main ingredient, and reference numeral 4 denotes an iron shell. In addition, the point that the blast of high-temperature gas is forced through the tuyere main body 1 into a furnace is the same as a related art.

According to the present invention, there is employed a structure in which the tuyere main body 1, which is covered on an outer periphery thereof with a ring member 2 baked in advance, is disposed in a hole portion 5 provided in a tuyere brick 6, and a periphery of the ring member 2 is filled with the ramming material 3 so as to be fixed. Here, "baking in advance" means a so-called precast, and it also means that a ceramic raw material is baked in advance so as to be formed into a ceramic compact having a predetermined shape and a predetermined strength. The ring member 2 has a thickness of about 100 mm.

In addition, the tuyere main body 1, which is attached on the outer periphery with the ring member 2 baked in advance, is disposed in the hole portion 5 provided in the tuyere brick 6, and the periphery of the ring member 2 is then filled with the ramming material 3 so as to be fixed to a predetermined position.

The ring member 2 is baked in advance (precasted) at a temperature of equal to or higher than 120° C. so that the strength thereof is equal to or higher than 18 MPa.

That is, by supporting the tuyere main body 1 with the ring member 2 having a predetermined strength, it is possible to prevent damage such as local melting loss in the vicinity of the tuyere unlike the related art and ensure sufficient strength, thereby significantly extending the life of the tuyere.

In addition, when the baking temperature exceeds 600° C., significant carbon oxidation occurs and the deterioration of a surface layer is started at a temperature of equal to or higher than 700° C. In consideration of production efficiency, at an upper baking temperature limit of about 300° C., it is possible to ensure a strength of about 18 to 30 MPa, which is sufficient for the tuyere structure.

Figure 4:
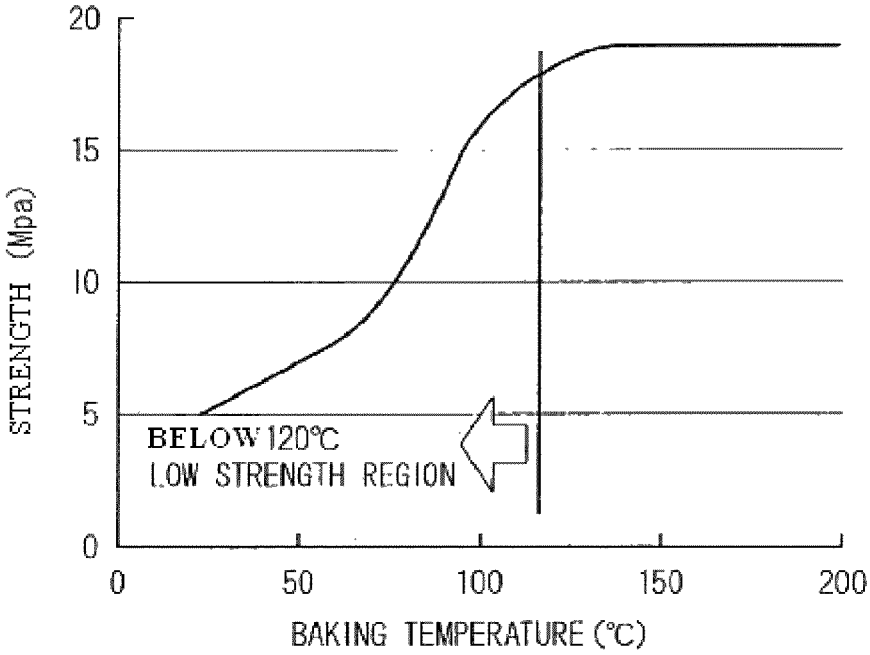
FIG. 4 is a graph showing a relationship between the baking temperature and the strength of the ramming material.

FIG. 4 is a graph showing a relationship between the baking temperature and the strength of the ramming material. As shown by the graph, it can be seen that when baking is performed at a temperature of less than 120° C., the strength is decreased to less than 18 MPa, and the desired strength cannot be obtained. That is, as in the related art, in the case where the periphery of the tuyere main body 1 is filled with the ramming material to bake the ramming material at an operational temperature of the furnace, in a low-temperature state due to, for example, water cooling of the tuyere main body 1, there is no situation in which the ramming material which comes in direct contact with the tuyere main body 1 is heated to 120° C. or higher. Accordingly, it was found that, for this reason, sufficient strength cannot be exhibited, and as a result, local melting loss portions of the ramming material or strength-deficient portions occur after drying. Therefore, according to the present invention, the need for more properly exhibiting the strength of the ramming material is recognized, and it is predicted that sufficient strength of the ramming material is related to the prevention of the local melting loss in the vicinity of the tuyere.

Figure 2A:
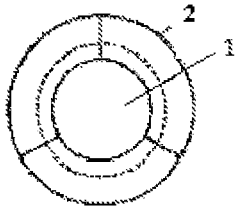
FIG. 2A is a front view showing a ring member of the tuyere structure.
Figure 2B:
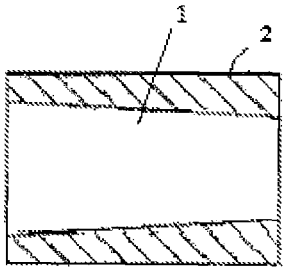
FIG. 2B is a cross-sectional view showing the ring member of the tuyere structure.
Figure 3:
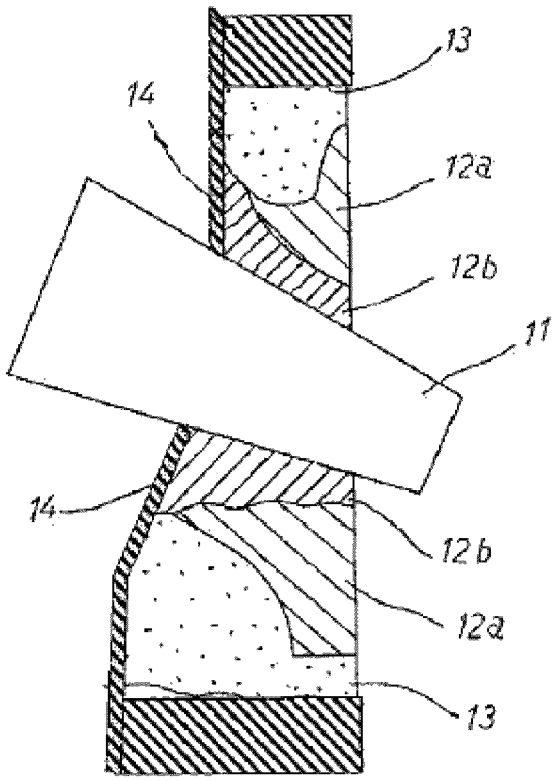
FIG. 3 is a cross-sectional view showing an existing example of a tuyere structure of a melting furnace.

As shown in FIGS. 2A and 2B, the ring member 2 is divided in a circumferential direction (into 3 parts in the shown example) so as to be easily mounted to the tuyere main body 1. Of course, with regard to the dividing method, an arbitrary shape or an arbitrary division number may be employed depending on the outer shape of the tuyere main body 1. In addition, since a cross-sectional shape of the ring member 2, which is perpendicular to an axial line thereof, is a ring shape, as compared with a case where a polygonal shape (for example, a square shape) is employed as the cross-sectional shape, wear resistance and strength thereof become uniform along the circumferential direction, which is preferable.

The ring member 2 is made of the same material as the ramming material 3. For example, the ring member 2 is made of a ceramic raw material having 69% of $Al_2O_3$, 0.3% of $SiO_2$, 23% of SiC, and 3% of C in weight %. Since the material of the ring member 2 is the same as the ramming material 3, the generation of a gap between the two which is caused by thermal expansion can be avoided to the maximum, which is preferable.

In the past, the ramming material directly came in contact with the tuyere main body which is cooled to be protected, such that it could not be sufficiently dried, the strength thereof could not be exhibited, and this caused local melting loss. On the contrary, in the tuyere structure of this embodiment having the above-described configuration, the tuyere main body is supported by the ring member having a predetermined strength, so that it is possible to prevent local melting loss in the vicinity of the tuyere and exhibit sufficient strength, thereby significantly extending the life of the tuyere. Moreover, since there is no local melting loss, there is no situation in which the iron shell is exposed. Therefore, an increase in operational load due to heat loss caused by the degradation of insulation effect can be eliminated.

In addition, in the tuyere structure described above, damage such as local melting loss was not observed even after 90 days, and sufficient strength was maintained. Therefore, it can be seen that the life thereof can be significantly extended as compared with the existing structure that requires replacement after about 30 days.

As shown by the above description, the present invention provides the structure in which the tuyere main body, which is covered on an outer periphery thereof with the ring member baked in advance, is disposed in the hole portion provided in the tuyere brick, and a periphery of the ring member is filled with the ramming material so as to be fixed. Therefore, there is no damage such as local melting loss in the vicinity of the tuyere and the sufficient strength is maintained, so that it is possible to significantly extend the life of the tuyere. In addition, it is possible to prevent an increase in operational load due to heat loss caused by the local melting loss.

INDUSTRIAL APPLICABILITY

The tuyere structure of the melting furnace of the present invention employs the structure in which the tuyere main body, which is covered on the outer periphery thereof with the ring member baked in advance, is disposed in the hole portion provided in the tuyere brick, and the periphery of the ring member is filled with the ramming material so as to be fixed. Therefore, the ring member, which has sufficient wear resistance and strength since it is baked in advance, comes in direct contact with the tuyere main body which is cooled to be protected, so that there is no situation in which local melting loss portions of the ramming material or strength-deficient portions after drying occurs unlike the existing structure. As a result, it is possible to exhibit sufficient strength and excellent durability.

The invention claimed is:

1. A tuyere structure of a melting furnace comprising a tuyere brick having a hole portion, and in the hole portion:

a tuyere main body which is water-cooled;

a precasted ring member disposed around an outer periphery of the tuyere main body, the ring member having a strength of equal to or higher than 18 MPa, wherein the ring member is in direct contact with, and is fixed to, the tuyere main body; and a ramming material filling the space in the hole portion between an outer periphery of the ring member and the tuyere brick so as to fix the ring member in the hole portion, wherein the ring member is made of the same material as that of the ramming material.

2. The tuyere structure according to claim 1, wherein the ring member is baked in advance at a temperature of equal to or higher than 120° C.

3. The tuyere structure according to claim 1, wherein the ring member is divided in a circumferential direction.

4. The tuyere structure according to claim 1, wherein the ring member and the ramming material are made of a ceramic material containing alumina as the main ingredient.

5. The tuyere structure according to claim 4, wherein said ceramic material contains approximately 69% of alumina, 0.3% of $SiO_2$, 23% of SiC, and 3% of C.

* * * * *

UNITED STATES PATENT AND TRADEMARK OFFICE

CERTIFICATE OF CORRECTION

PATENT NO. : 8,480,951 B2
APPLICATION NO. : 12/733516
DATED : July 9, 2013
INVENTOR(S) : Yasunari Matsumura et al.

It is certified that error appears in the above-identified patent and that said Letters Patent is hereby corrected as shown below:

In the Specification

Column 4, line 3, change “ceramic mainly containing” to -- ceramic containing --.

Signed and Sealed this
Fifth Day of August, 2014

Michelle K. Lee

Michelle K. Lee
*Deputy Director of the United States Patent and Trademark Office*